US011441793B2

(12) United States Patent
Cho et al.

(10) Patent No.: US 11,441,793 B2
(45) Date of Patent: Sep. 13, 2022

(54) AIR CONDITIONER

(71) Applicant: LG Electronics Inc., Seoul (KR)

(72) Inventors: Eunjun Cho, Seoul (KR); Kiwoong Park, Seoul (KR); Hyungyul Yum, Seoul (KR); Pilhyun Yoon, Seoul (KR)

(73) Assignee: LG Electronics Inc., Seoul (KR)

( * ) Notice: Subject to any disclaimer, the term of this patent is extended or adjusted under 35 U.S.C. 154(b) by 278 days.

(21) Appl. No.: 16/678,510

(22) Filed: Nov. 8, 2019

(65) Prior Publication Data

US 2020/0149751 A1 May 14, 2020

(30) Foreign Application Priority Data

Nov. 8, 2018 (KR) ..... 10-2018-0136693

(51) Int. Cl.
*F24F 1/16* (2011.01)
*F24F 11/81* (2018.01)
(Continued)

(52) U.S. Cl.
CPC ..... *F24F 1/16* (2013.01); *F24F 1/0003* (2013.01); *F24F 1/0068* (2019.02); *F24F 1/08* (2013.01);
(Continued)

(58) Field of Classification Search
CPC ..... F24F 1/0003; F24F 1/0068; F24F 1/08; F24F 1/14; F24F 11/81; F25B 40/00; F25B 41/20; F25B 2313/02523; F25B 2313/02533; F25B 2313/02541; F25B 2500/02; F28F 9/026; F28F 2250/06
See application file for complete search history.

(56) References Cited

U.S. PATENT DOCUMENTS

2012/0118533 A1* 5/2012 Jang ..... F28F 27/02 165/96
2016/0054077 A1 2/2016 Saito et al.

FOREIGN PATENT DOCUMENTS

EP 1400765 3/2004
EP 2975336 1/2016
(Continued)

OTHER PUBLICATIONS

Machine translation of KR 1020180104416 (Year: 2018).*
(Continued)

*Primary Examiner* — Joseph F Trpisovsky
(74) *Attorney, Agent, or Firm* — Fish & Richardson P.C.

(57) ABSTRACT

Provided is an air conditioner capable of improving heating performance in a cold region by reducing a refrigerant pressure loss in an outdoor heat exchanger in a heating operation. The air conditioner includes a compressor, an outdoor heat exchanger, an expansion device, and an indoor heat exchanger. The outdoor heat exchanger may include a plurality of unit channels into which a refrigerant channel is partitioned, and a separating device installed in each of the plurality of unit channels and configured to separate a liquid refrigerant component and a vapor refrigerant component in each of the plurality of unit channels in a heating operation. The air conditioner may further include a compressor suction channel connecting a heating-operation outlet of the outdoor heat exchanger and an inlet of the compressor, and a bypass pipe connecting the separating device and the compressor suction channel.

14 Claims, 9 Drawing Sheets

(51) Int. Cl.

| | |
|---|---|
| ***F24F 1/0068*** | (2019.01) |
| ***F24F 1/0003*** | (2019.01) |
| ***F24F 1/08*** | (2011.01) |
| ***F24F 1/14*** | (2011.01) |
| ***F25B 41/20*** | (2021.01) |

(52) U.S. Cl.
CPC ..... *F24F 1/14* (2013.01); *F24F 11/81* (2018.01); *F25B 41/20* (2021.01)

(56) References Cited

FOREIGN PATENT DOCUMENTS

| | | |
|---|---|---|
| JP | H09152216 | 6/1997 |
| JP | 2011247473 | 12/2011 |
| JP | 2015010816 | 1/2015 |
| KR | 1020120053730 | 5/2012 |
| KR | 1020140083320 | 7/2014 |
| KR | 1020180104416 | 9/2018 |
| WO | WO2010117973 | 10/2010 |

OTHER PUBLICATIONS

Korean Office Action in Korean Application No. 10-2018-0136693, dated Jul. 17, 2020, 12 pages (with English translation).
Korean Notice of Allowance in KR Appln. No. 10-2018-0136693, dated Dec. 1, 2020, 4 pages (with English translation).
Extended European Search Report in European Application No. 19207975.4, dated Apr. 7, 2020, 6 pages.
Korean Office Action in Korean Application No. 10-2018-0136693, dated May 11, 2020, 12 pages (with English translation).

* cited by examiner

AIR CONDITIONER

CROSS-REFERENCE TO RELATED APPLICATION

This application claims the benefit of priority to Korean Application No. 10-2018-0136693, filed on Nov. 8, 2018. The disclosure of the prior application is incorporated by reference in its entirety.

BACKGROUND OF THE INVENTION

Field of the Invention

The present invention relates to an air conditioner and more particularly to an air conditioner to be installed in a cold region.

Related Art

In general, an air conditioner is a device for cooling or heating indoor air using a refrigerant cycle apparatus comprised of compressor, an outdoor heat exchanger, an expansion device, and an indoor heat exchanger.

In the case of cooling the indoor air, the outdoor heat exchanger functions as a condenser, the indoor heat exchanger functions as an evaporator, and a refrigerant circulates by passing through the compressor, the outdoor heat exchanger, the expansion device, the indoor heat exchanger, and the compressor in order.

In the case of heating the indoor air, the outdoor heat exchanger functions as an evaporator, the indoor heat exchanger functions as a condenser, and a refrigerant circulates by passing through the compressor, the indoor heat exchanger, the expansion device, the outdoor heat exchanger, and the compressor in order.

Yet, in a cold region, outdoor air is at an extremely low temperature. In this case, in a heating operation, a refrigerant pressure loss inside the outdoor heat exchanger excessively increase, which leads to low heating performance.

SUMMARY OF THE INVENTION

The present invention provides an air conditioner capable of improving heating performance in a cold region by reducing a pressure loss of a refrigerant inside an outdoor heat exchanger in a heating operation.

The present invention also provides an air conditioner capable of improving heating performance in a cold region by reducing a flux of refrigerants inside the outdoor heat exchanger to further reduce pressure loss of refrigerants flowing at a rear end of the outdoor heat exchanger.

Objects of the present invention should not be limited to the aforementioned objects and other unmentioned objects will be clearly understood by those skilled in the art from the following description.

In an aspect, there is provided an air conditioner including a compressor, an outdoor heat exchanger, an expansion device, and an indoor heat exchanger. The outdoor heat exchanger may include a plurality of unit channels into which a refrigerant channel is partitioned, and a separating device installed in each of the plurality of unit channels and configured to separate a liquid refrigerant component and a vapor refrigerant component in each of the plurality of unit channels in a heating operation. The air conditioner may further include a compressor suction channel connecting a heating-operation outlet of the outdoor heat exchanger and an inlet of the compressor, and a bypass pipe connecting the separating device and the compressor suction channel to bypass the vapor refrigerant component separated by the separating device in the heating operation to the compressor suction channel.

The separating device may be a return pipe that connects two adjacent refrigerant pipes in a plurality of refrigerant pipes respectively provided in the plurality of unit channels.

The return pipe may include a pair of straight parts arranged in parallel to each other, and an arc-shaped bending part connecting one ends of the straight parts to each other, and the bypass pipe may be connected to the bending part arranged in a longitudinal direction of any one of the straight parts.

An expansion part having an inner space larger than a remaining space may be formed in any one of the straight parts.

The return pipe may include a pair of straight parts arranged in parallel to each other, and a spring-shaped bending part connecting one ends of the straight parts to each other; and the bypass pipe may be connected to the bending part arranged in a longitudinal direction of any one of the straight parts.

The compressor suction channel may include an accumulator for separating the liquid refrigerant component and the vapor refrigerant component, and a compressor inflow pipe connecting an outlet of the accumulator and the inlet of the compressor; and the bypass pipe may connect the separating device and the compressor inflow pipe.

A flow rate control valve for opening the bypass pipe in a heating operation and closing the bypass pipe in a cooling operation may be installed in the bypass pipe.

The air conditioner may further include a first parallel connection channel connecting one sides of the plurality of unit channels in parallel to each other, and introducing a refrigerant introduced into the outdoor heat exchanger to the plurality of unit channels, respectively, in the heating operation, a second parallel connection channel connecting the other sides of the plurality of unit channels in parallel to each other, and discharging the refrigerant having passed through the plurality of unit channels to an outside of the outdoor heat exchanger in the heating operation, and a serial connection channel connecting the plurality of unit channels in serial to each other, and bypassing the refrigerant having passed through one unit channel in the plurality of unit channels to an inlet the other unit channel in the cooling operation.

A backflow preventing valve for preventing the refrigerant having passed through one unit channel in of the plurality of unit channels from backflowing to an outlet of the other unit channel in a cooling operation may be installed in the first parallel connection channel.

A parallel connection valve for closing the first parallel connection channel in the cooling operation and opening the second parallel connection channel in the heating operation may be installed in the second parallel connection channel.

A serial connection valve may be installed for opening the serial connection channel in the cooling operation and closing the serial connection channel in the heating operation is installed in the serial connection channel.

The compressor suction channel may include an accumulator for separating the liquid refrigerant component and the vapor refrigerant component, and a first refrigerant pipe for connecting the heating-operation outlet of the outdoor heat exchanger and an inlet of the accumulator; and the bypass pipe may connect the separating device and the first refrigerant pipe.

The compressor suction channel may include an accumulator for separating the liquid refrigerant component and the vapor refrigerant component, and the bypass pipe may connect the separating device and the accumulator.

The air conditioner may further include a supercooling device installed in a second refrigerant pipe connecting a heating-operation outlet of the indoor heat exchanger and a heating-operation inlet of the expansion device. The bypass pipe may pass through the supercooling device.

The compressor unction channel may further include a compressor inflow pipe connecting an outlet of the accumulator and the inlet of the compressor, a supercooling device installed in a second refrigerant pipe connecting a heating-operation outlet of the indoor heat exchanger and a heating-operation inlet of the expansion device, and an auxiliary bypass pipe connecting the accumulator and the compressor inflow pipe and passing through the supercooling device. The auxiliary bypass pipe may cause, in the heating operation, the liquid refrigerant component separated in the accumulator to change into a vapor refrigerant component and be then bypassed to the compressor inflow pipe.

The details of other embodiments are included in the following description and the accompanying drawings.

DESCRIPTION OF EXEMPLARY EMBODIMENTS

Figure 1:
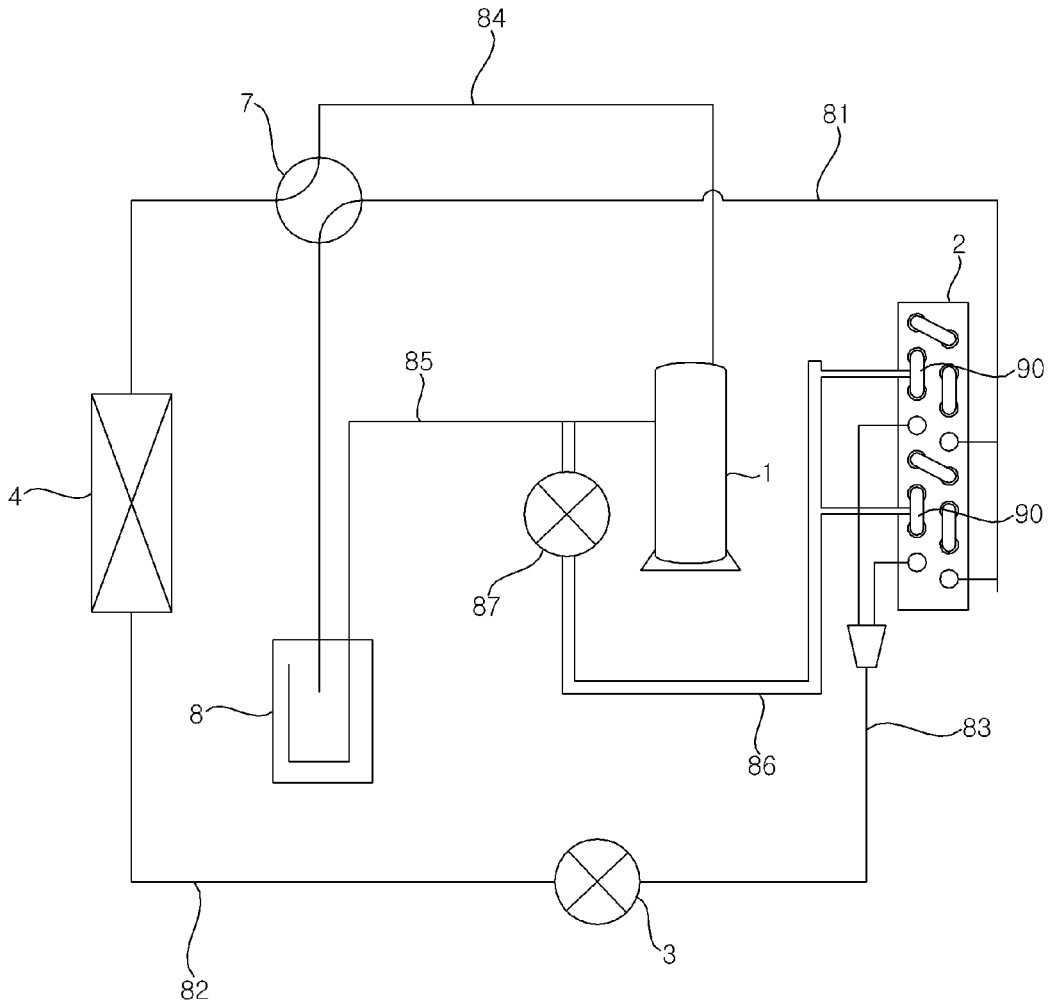
FIG. 1 is a diagram illustrating a configuration of an air conditioner according to a first embodiment of the present invention.

Advantages and characteristics of the present invention, and a method of achieving the advantages and characteristics will be clear with reference to an exemplary embodiment to be described in detail together with the accompanying drawings. The present invention may, however, be embodied in different forms and should not be construed as limited to the embodiments set forth herein. Rather, these embodiments are provided so that this invention will be thorough and complete, and will fully convey the scope of the present invention to those skilled in the art. Further, the present invention is only defined by scopes of claims. Like reference numerals refer to like elements throughout.

Hereinafter, an air conditioner according to embodiments of the present invention will be described with reference to the accompanying drawings.

FIG. 1 is a diagram illustrating a configuration of an air conditioner according to a first embodiment of the present invention.

Referring to FIG. 1, an air conditioner according to an embodiment of the present invention may include a compressor 1, an outdoor heat exchanger 2, an expansion device 3, and an indoor heat exchanger 4.

The compressor 1, the outdoor heat exchanger 2, the expansion device 3, and the indoor heat exchanger 4 may be connected to each other via refrigerant pipes.

The compressor 1, the outdoor heat exchanger 2, and the expansion device 3 may form an outdoor unit. The outdoor unit may include an outdoor blower (not shown) for blowing air toward the outdoor heat exchanger 2. Outdoor air may be introduced into the outdoor unit upon rotation of the outdoor blower, heat-exchanged with the outdoor heat exchanger 2, and then discharged to an outside.

The indoor heat exchanger 4 may form an indoor unit. The indoor unit may further include an indoor blower (not shown) for blowing air toward the indoor heat exchanger 4. Indoor air may be introduced into the indoor unit upon rotation of the indoor blower, heat-exchanged with the indoor heat exchanger 4, and then discharged to an inside.

In a cooling operation of the air conditioner, the outdoor heat exchanger 2 may function as a condenser and the indoor heat exchanger 4 may function as an evaporator. In the cooling operation of the air conditioner, a refrigerant may circulate by passing through the compressor 1, the outdoor heat exchanger 2, the expansion device 3, the indoor heat exchanger 4, and then the compressor 1, sequentially.

In a heating operation of the air conditioner, the outdoor heat exchanger 2 may function as an evaporator and the indoor heat exchanger 4 may function as a condenser. In the heating operation of the air conditioner, a refrigerant may circulate by passing through the compressor 1, the indoor heat exchanger 4, the expansion device 3, the outdoor heat exchanger 2, and then the compressor 1, sequentially.

The compressor 1 may compress a refrigerant. The condenser may condense a refrigerant having passed through the compressor 1. The expansion device 3 may expand a refrigerant having passed through the condenser. The evaporator may evaporate a refrigerant having passed through the expansion device 3.

The air conditioner may be implemented as an air conditioner capable of performing both a cooing operation and a heating operation. However, the air conditioner may be implemented as an air conditioner capable of performing only a heating operation.

Hereinafter, the air conditioner will be described as being implemented as an air conditioner capable of performing both a cooing operation and a heating operation.

The air conditioner according to an embodiment of the present invention may further include a cooling and heating switch valve 7. The cooling and heating switch valve 7 may be included in the outdoor unit. The cooling and heating switch valve 7 may switch a flow of refrigerants discharged from the compressor 1 to one of the outdoor heat exchanger 2 and the indoor heat exchanger 4.

A compressor suction channel 81, 8, 85 may connect a heating-operation outlet of the outdoor heat exchanger 2 and an inlet of the compressor 1. The compressor suction channel 81, 8, 85 may include an accumulator 8 for separating a refrigerant into a liquid refrigerant component and a vapor refrigerant component, a first refrigerant pipe 81 connecting the heating-operation outlet of the outdoor heat exchanger 2 and the inlet of the compressor 1, and a compressor inflow pipe 85 connecting an outlet of the accumulator 8 and an inlet of the compressor 1.

In a heating operation of the air conditioner, a liquid refrigerant component and a vapor refrigerant component may flow from the outdoor heat exchanger 2 to the accumulator 8 through the first refrigerant pipe 81. Having flown into the accumulator 8, the refrigerant may be separated into a liquid refrigerant component and a vapor refrigerant component.

The liquid refrigerant component separated in the accumulator 8 may be received in a lower side of the accumulator, and the vapor refrigerant component separated in the accumulator 8 may be positioned above the separated liquid refrigerant.

The vapor refrigerant component separated in the accumulator 8 may flow to the compressor 1 through the compressor inflow pipe 85, and the liquid refrigerant component separated in the accumulator 8 may remain intact in the accumulator 8.

A second refrigerant pipe 82 may connect a heating-operation outlet of the indoor heat exchanger 4 and a heating-operation inlet of the expansion device 3.

A third refrigerant pipe 83 may connect a heating-operation outlet of the expansion device 3 and a heating-operation inlet of the outdoor heat exchanger 2.

A fourth refrigerant pipe 84 may connect an outlet of the compressor 1 and a heating-operation inlet of the indoor heat exchanger 4.

The cooling and heating switch valve 7 may be installed in the first refrigerant pipe 81 and the fourth refrigerant pipe 84.

The flow of a refrigerant in a heating operation of the air conditioner may be described as below. A refrigerant compressed in the compressor 1 moves to the cooling and heating switch valve through a front portion of the fourth refrigerant pipe 84. The refrigerant having moved to the cooling and heating switch valve 7 moves to the indoor heat exchanger 4 through a rear portion of the fourth refrigerant pipe 84. The refrigerant pipe having moved to the indoor heat exchanger 4 moves to the expansion device 3 through the second refrigerant pipe 82. The refrigerant having moved to the expansion device 3 moves to the outdoor heat exchanger 2 through the third refrigerant pipe 83. The refrigerant having moved to the outdoor heat exchanger 2 moves to the cooling and heating switch valve 7 through a front portion of the first refrigerant pipe 81. The refrigerant having moved to the cooling and heating switch valve 7 moves to the accumulator 8 through a rear portion of the first refrigerant pipe 81. The refrigerant having moved to the accumulator 8 moves to the compressor 1 through the compressor inflow pipe 85. In the heating operation of the air conditioner, the refrigerant repeatedly flow in this manner.

Meanwhile, the flow of a refrigerant in a cooling operation of the air conditioner may be described as below. A refrigerant compressed in the compressor 1 moves to the cooling and heating switch valve 7 through a front portion of the fourth refrigerant pipe 84. The refrigerant having moved to the cooling and heating switch valve 7 moves to the outdoor heat exchanger 2 through a front portion of the first refrigerant pipe 81. The refrigerant having moved to the outdoor heat exchanger 2 moves to the expansion device 3 through the second refrigerant pipe 82. The refrigerant having moved to the expansion device 3 moves to the indoor heat exchanger 4 through the second refrigerant pipe 82. The refrigerant having moved to the indoor heat exchanger 4 moves to the cooling and heating switch valve through a rear portion of the fourth refrigerant pipe 84. The refrigerant having moved to the cooling and heating switch valve 7 moves to the accumulator 8 through a rear portion of the first refrigerant pipe 81. The refrigerant having moved to the accumulator 8 moves to the compressor 1 through the compressor inflow pipe 85. In a cooling operation of the air conditioner, the refrigerant repeatedly flow in this manner.

Figure 2:
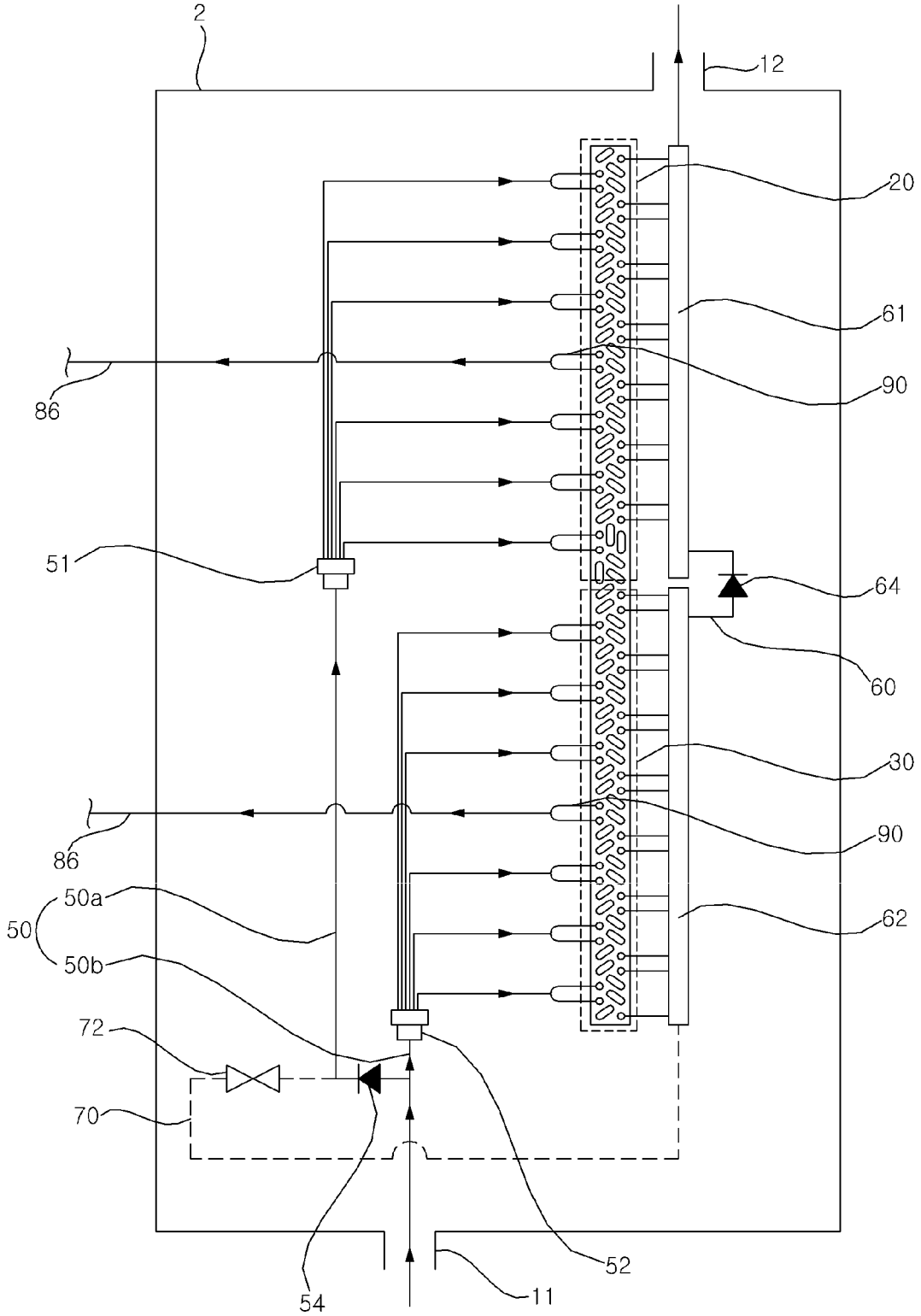
FIG. 2 is a diagram illustrating a refrigerant flow in an outdoor heat exchanger, shown in FIG. 1, in a heating operation of the air conditioner according to the first embodiment of the present invention.
Figure 3:
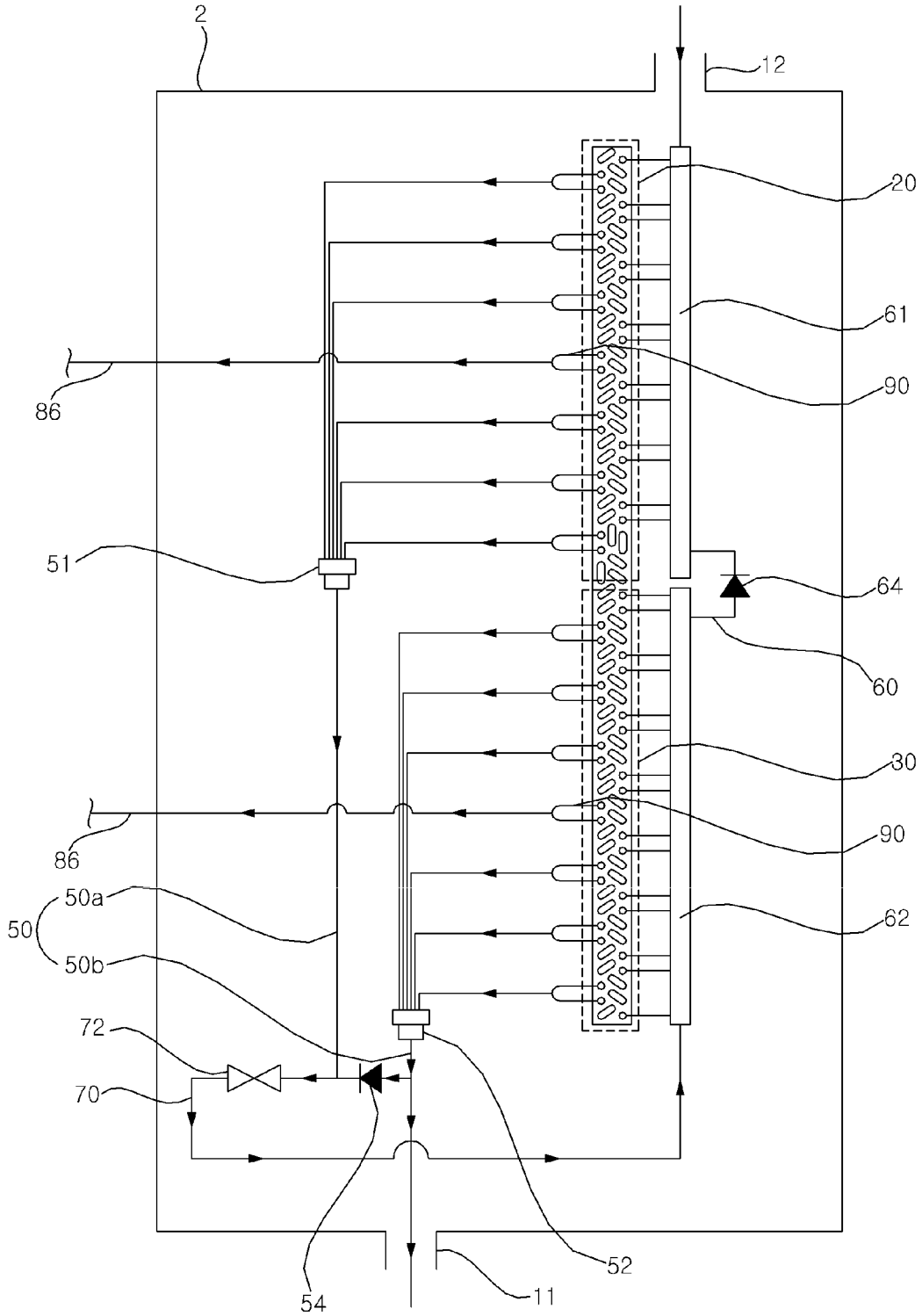
FIG. 3 is a diagram illustrating a refrigerant flow in an outdoor heat exchanger, shown in FIG. 1, in a cooling operation of the air conditioner according to the first embodiment of the present invention.

FIG. 2 is a diagram illustrating a refrigerant flow in an outdoor heat exchanger, shown in FIG. 1, in a heating operation of the air conditioner according to the first embodiment of the present invention. FIG. 3 is a diagram illustrating a refrigerant flow in an outdoor heat exchanger, shown in FIG. 1, in a cooling operation of the air conditioner according to the first embodiment of the present invention.

Referring to FIGS. 1 to 3, the outdoor heat exchanger 2 may include a plurality of unit channels 20 and 30 into which a refrigerant channel is partitioned. In the present embodiment, it is described that the refrigerant channel of the outdoor heat exchanger 2 is partitioned into two unit channels. However, aspects of the present invention are not limited thereto, and the refrigerant channel of the outdoor heat exchanger 2 may be partitioned into three or more unit channels. In the present embodiment, it is described that the refrigerant channel of the outdoor heat exchanger 2 is partitioned into a first unit channel 20 and a second unit channel 30.

One side of the first unit channel 20 and one side of the second unit channel 30 are connected in parallel to each other by a first parallel connection channel 50. The other side of the first unit channel 20 and the other side of the second unit channel 30 are connected in parallel to each other by a second parallel connection channel 60.

In the first parallel connection channel 50, a first distributor 51 corresponding to the first unit channel 20 and a second distributor 52 corresponding to the second unit channel 30 are installed.

The first distributor 51 plays a role of distributing introduced refrigerants into the first unit channel 20 in a heating operation, and the second distributor 52 plays a role of distributing introduced refrigerants into the second unit channel 30 in the heating operation.

The first parallel connection channel 50 includes a first distributor connecting channel 50*a* connecting an outlet of the outdoor heat exchanger 2 and the first distributor 51, and a second distributor connecting channel 50*b* connecting the outlet of the outdoor heat exchanger 2 and the second distributor 52.

In the second parallel connection channel 60, a first header 61 is installed at a portion corresponding to the first unit channel 20 and a second header 62 is installed at a portion corresponding to the second unit channel 30.

Although it is possible to change where to install the distributors 51 and 52 and the headers 61 and 62, it is advantageous that the distributors 51 and 52 are installed at a side through which a liquid refrigerant component is introduced, and it is advantageous that the headers 61 and 62 are installed at a side through which a vapor refrigerant component is introduced. Accordingly, it is preferable that the distributors 51 and 52 are positioned on the side of a first port 11 through which a two-phase refrigerant are introduced in a heating operation, and that the headers 61 and 62 are positioned on the side of a second port 12 through which a vapor refrigerant component is introduced in a cooling operation. Here, in the heating operation of the air conditioner, the first port 11 serves an inlet through which a refrigerant is introduced, and the second port 12 serves as an outlet through which a refrigerant is discharged. In addition, in the cooling operation of the air conditioner, the first port 11 serves as an outlet through which a refrigerant is discharged, and the second port 12 serves as an inlet through a refrigerant is introduced.

The outdoor heat exchanger 2 further includes a channel switching device for switching a channel so that the first parallel connection channel 50, the second parallel connection channel 60, and a serial connection channel 70, described below, may be selectively used.

The channel switching device may include an opening and closing valve installed in at least one of the first parallel connection channel 50, the second parallel connection channel 60, and the serial connection channel 70 to open and close a channel. In addition, the channel switching device may include a check valve for allowing a refrigerant to flow only in one direction.

The channel switching device includes a parallel connection valve 64, a serial connection valve 72, and a backward preventing valve 54, which are described below.

In the second parallel connection channel 60, the parallel connection valve 64 for closing the second parallel connection channel 60 in a cooling operation and opening the second parallel connection channel 60 in a heating operation is installed.

In the heating operation, the parallel connection valve 64 allows the first header 61 and the second header 62 to communicate with each other, so that the second parallel connection channel 60 is opened. In the cooling operation, the parallel connection valve 64 prevents a refrigerant having passed through the first header 61 from being introduced into the second header 62, so that the second parallel connection channel 60 is closed. In the first embodiment of the present invention, it is described that a check valve for allowing a refrigerant to flow only in one direction from the second header 62 toward the first header 61 is used as the parallel connection valve 64.

The first header 61 and the second header 62 may be installed in the first parallel connection channel 50, and the first distributor 51 and the second distributor 52 may be installed in the second parallel connection channel 60. However, it is more preferable that a distributor rather than a header is installed on the side through which a liquid refrigerant component passes.

The outdoor heat exchanger 2 may further include the serial connection channel 70 for connecting the first unit channel 20 and the second unit channel 30 in serial in a cooling operation.

In the cooling operation, the serial connection channel 70 allows a refrigerant having passed through the first unit channel 20 to be bypassed toward the second unit channel 30. That is, the serial connection channel 70 is bypassed from the first distributor channel 50*a* and thereby connected to the second header 62.

In the serial connection channel 70, the serial connection valve 72 for opening the serial connection channel 70 in the cooling operation and closing the serial connection channel 70 in the heating operation is installed.

In the first parallel connection channel 50, a backflow preventing valve 54 for preventing a refrigerant having passed through the first unit channel 20 from backflowing toward the second unit channel 30 in the cooling operation is installed in the first parallel connection channel 50. That is, the backflow preventing valve 54 may be installed between the first distributor channel 50*a* and the second distributor channel 50*b*, and a check valve may be used as the backflow preventing valve 54.

The outdoor heat exchanger 2 may further include a separating device installed at each of the plurality of unit channels 20 and 30 to separate a refrigerant into a liquid refrigerant component and a vapor refrigerant component in each of the plurality of unit channels 20 and 30 in the heating operation.

The separating device 90 may separate a refrigerant into a liquid refrigerant component and a vapor refrigerant component at a middle point in a corresponding unit channel of the plurality of unit channels 20 and 30.

The air conditioner may further include a bypass pipe 86 connecting the separating device 90 and the compressor suction channel 81, 8, 85 to bypass the vapor refrigerant component separated from the separating device 90 toward the compressor suction channel 81, 8, 85 in the heating operation.

The bypass pipe 86 may connect the separating device and the compressor inflow pipe 85.

One end of the bypass pipe 86 may be branched into two parts, and the two parts branched from one end of the bypass pipe 86 may be connected to the plurality of unit channels 20 and 30. That is, one of the two parts branched from one end of the bypass pipe 86 may be connected to a separating device 90 provided in the first unit channel 20, and the other one of the two parts may be connected to the separating device 90 provided in a separating device 90 provided in the second unit channel 30.

The other end of the bypass pipe 86 may be connected to a portion adjacent to the inlet of the compressor 1 in the compressor inflow pipe 85.

In the heating operation of the air conditioner, a refrigerant introduced into the bypass pipe 86 from the plurality of unit channels 20 and 30 in a heating operation may be introduced into the compressor 1 through the compressor inflow pipe 85.

In the bypass pipe 86, a flow rate control valve 87 for opening the bypass pipe 86 in the heating operation and closing the bypass pipe 86 in the cooling operation may be installed. The flow rate control valve 87 may be an opening/closing vale and may control an amount of refrigerants flowing after being introduced from the plurality of unit channels 20 and 30 into the bypass pipe 86.

Figure 4:
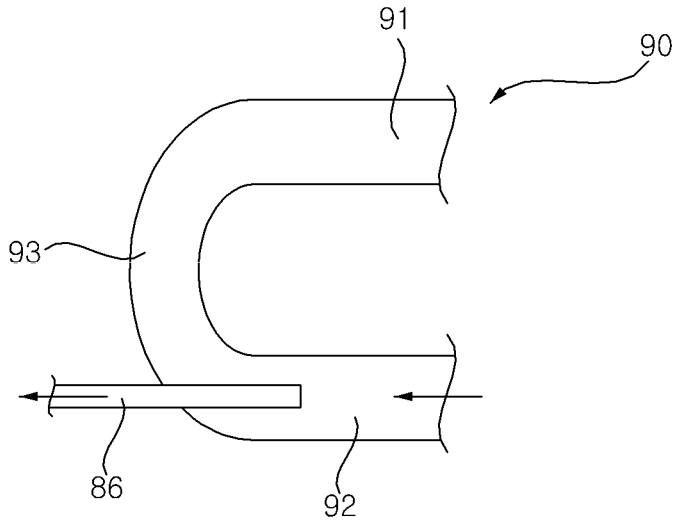
FIG. 4 is a diagram illustrating a first embodiment of a separating device shown in FIG. 1.

FIG. 4 is a diagram illustrating a first embodiment of a separating device shown in FIG. 1.

Referring to FIG. 4, the separating device 90 may be a return pipe 90 connecting two adjacent refrigerant pipes among a plurality of refrigerant pipes respectively provided in the plurality of unit channels 20.

The return pipe 90 may be provided in plural in each of the plurality of unit channels 20 and 30. One end of the bypass pipe 86 may be connected to a return pipe 90 positioned in the middle of a plurality of return pipe 90. That is, one of two parts branched from one end of the bypass pipe 86 may be connected to a return pipe 90 positioned in the middle of a plurality of return pipes 90 provided in the first unit channel 20, and the other one of the two parts branched from one end of the bypass pipe 86 may be connected to a return pipe 90 positioned in the middle of a plurality of return pipes 90 provided in the second unit channel 30.

A return pipe 90 may be formed in a U shape. That is, the return pipe 90 may include a pair of straight parts 91 and 92 arranged in parallel to each other, an arc-shaped bending portion 93 connecting one ends of the straight parts 91 and 92 to each other.

The pair of straight parts 91 and 92 may include a first straight part 91 and a second straight part 92.

The bypass pipe 86 may be connected to the bending part positioned in a longitudinal direction of any one of the straight parts 91 and 92. That is, the two parts branched from one end of the bypass pipe 86 may be connected to the bending part 93 positioned in the longitudinal direction of any one of the straight parts 91 and 92. The two parts branched from one end of the bypass pipe 86, branched into two parts may be connected to the bending part 93 positioned in the longitudinal direction of the second straight part 92.

A diameter of the bypass pipe 86 may be formed smaller than a diameter of the return pipe 90. A vapor refrigerant component in a liquid refrigerant component and the vapor refrigerant component separated in the return pipe 90 may flow into the bypass pipe 86 having a diameter smaller than the diameter of the return pipe 90.

Figure 5:
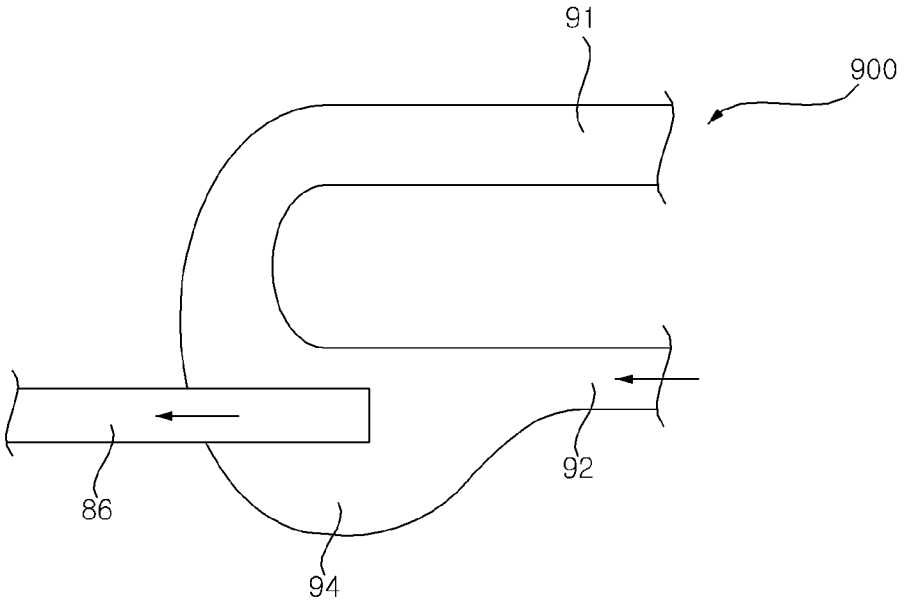
FIG. 5 is a diagram illustrating a second embodiment of a separating device shown in FIG. 1.

FIG. 5 is a diagram illustrating a second embodiment of a separating device shown in FIG. 1. Here, the same elements as in the first embodiment of the separating device shown in FIG. 4 are indicated by the same reference numerals, and a detailed description of the same elements will be omitted only a difference from the separating device shown in FIG. 4 will be described.

Referring to FIG. 5, a return pipe 900 may include a pair of straight parts 91 and 92, and an arch-shaped bending part 93 connecting one ends of the straight parts 91 and 92. In any one of the straight parts 91 and 92, an expansion part 94 having an inner space larger than the remaining space may be formed. In the second straight part 92, an expansion part 94 having an inner space larger than the remaining space of the second straight part 92 may be formed. As for the liquid refrigerant component and the vapor refrigerant component separated in the return pipe 900, the liquid refrigerant component may be stored in the expansion part 94, and the vapor refrigerant component may move to the bypass pipe 86.

Figure 6:
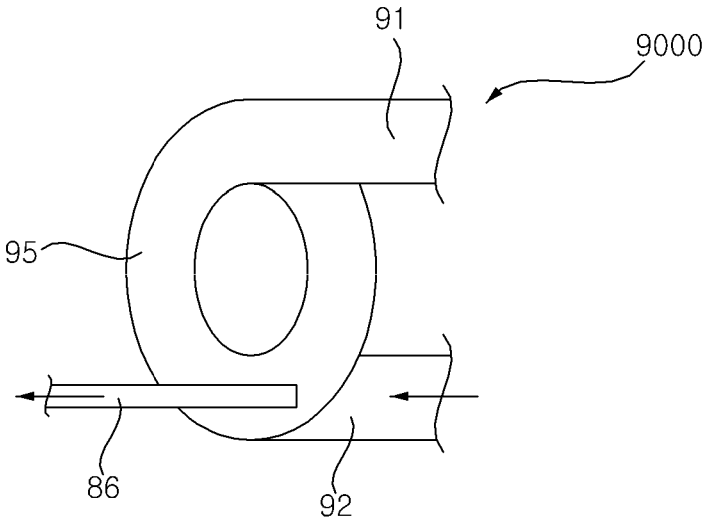
FIG. 6 is a diagram illustrating a third embodiment of a separating device shown in FIG. 1.

FIG. 6 is a diagram illustrating a third embodiment of a separating device shown in FIG. 1. Here, the same elements as in the first embodiment of the separating device shown in FIG. 4 are indicated by the same reference numerals, and a detailed description of the same elements will be omitted only a difference from the separating device shown in FIG. 4 will be described.

A return pipe 9000 may include a straight parts 91 and 92 arranged in parallel to each other, and a spring-shaped bending part 95 connecting one end of the straight parts 91 and 92. The bypass pipe 86 may be connected to the bending part 95 positioned in a longitudinal direction of any one of the straight parts 91 and 92.

A refrigerant introduced into the bending part 95 may be separated into a liquid refrigerant component and a vapor refrigerant component while rotating about a virtual straight line vertical to the longitudinal direction of any one of the straight parts 91 and 92.

Such a separating device may have the same meaning of the return pipes 90, 900, and 9000. Hereinafter, the separating device will be described with reference numeral 90.

Figure 7:
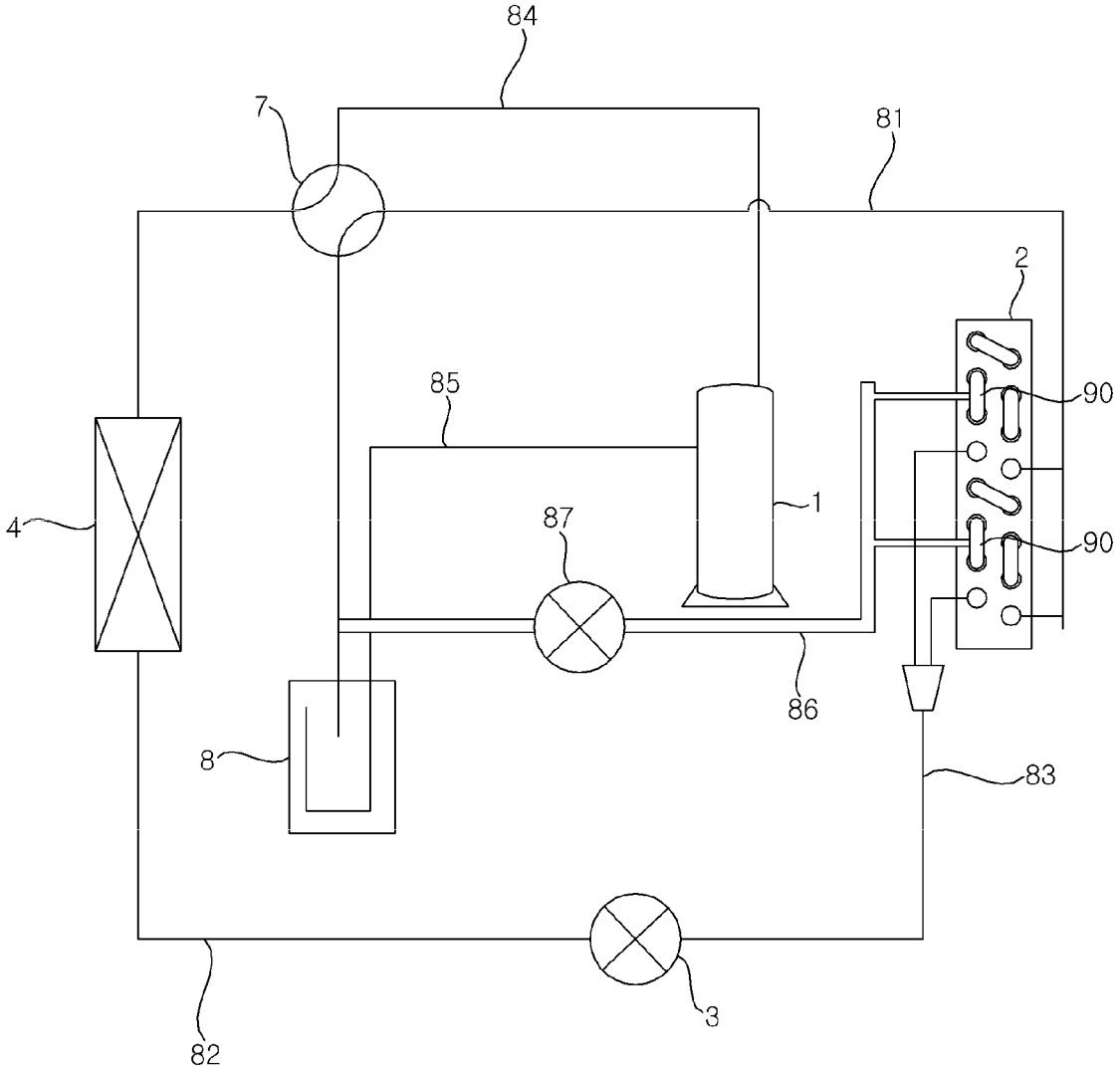
FIG. 7 is a diagram illustrating a configuration of an air conditioner according to a second embodiment of the present invention.

FIG. 7 is a diagram illustrating a configuration of an air conditioner according to a second embodiment of the present invention. Here, the same elements identical to those in the first embodiment of the air conditioner shown in FIG. 1 are indicated by the same reference numerals, and a detailed description of the same elements will be omitted and only a difference from the first embodiment of the air conditioner will be described.

Referring to FIG. 7, a bypass pipe 86 may connect a separating device 90 and a first refrigerant pipe 81. The bypass refrigerant pipe 86 may be connected to a portion adjacent to an inlet of the accumulator 8 in the first refrigerant pipe 81.

In the heating operation of the air conditioner, a refrigerant introduced into the bypass pipe 86 from the plurality of unit channels 20 and 30 may be introduced into the accumulator 8 through the first refrigerant pipe 81 and then separated into a liquid refrigerant component and a vapor refrigerant component. The vapor refrigerant component separated in the accumulator 8 may be introduced into the compressor 1 through the compressor inflow pipe 85, and the liquid refrigerant component separated in the accumulator 8 may remain intact in the accumulator 8.

Figure 8:
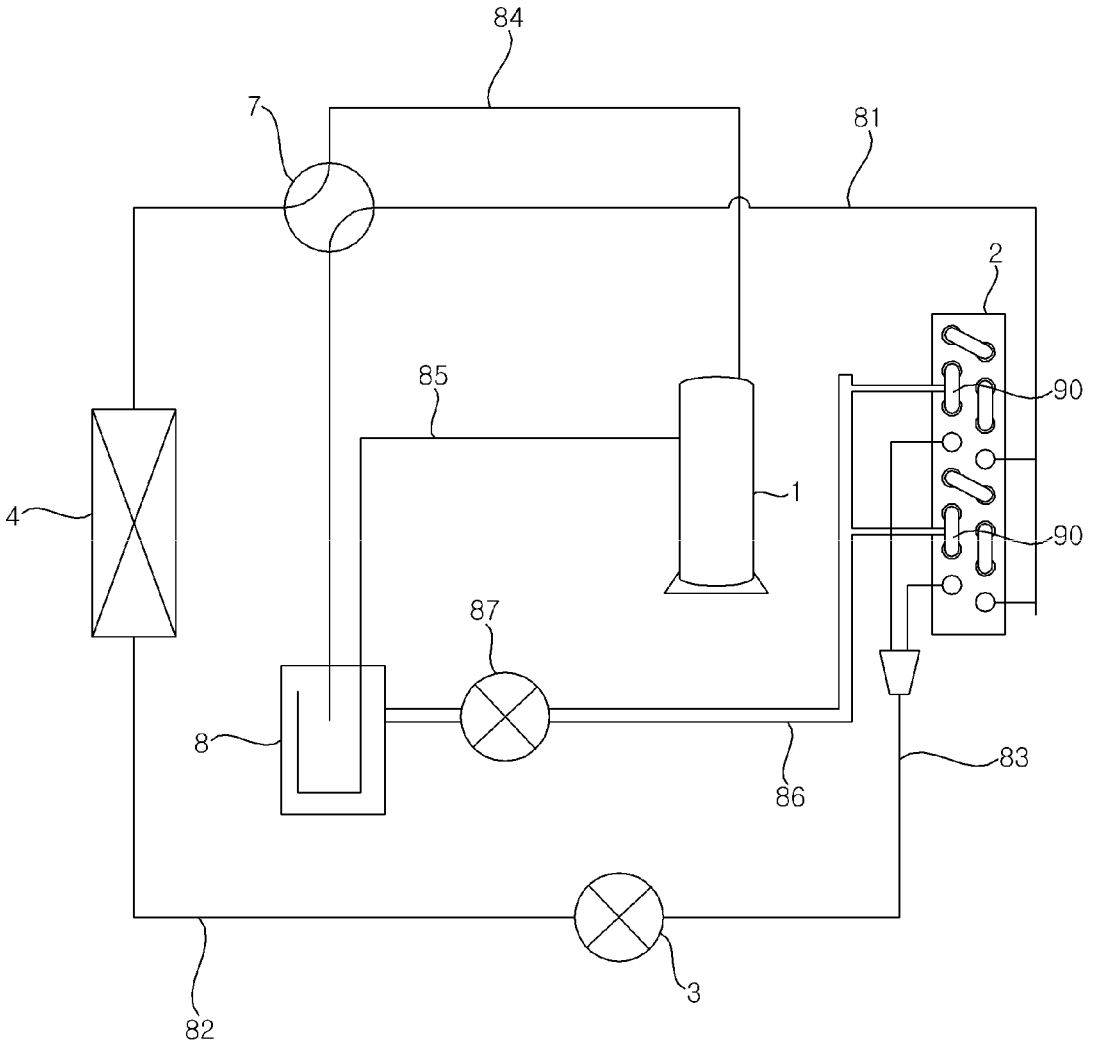
FIG. 8 is a diagram illustrating a configuration of an air conditioner according to a third embodiment of the present invention.

FIG. 8 is a diagram illustrating a configuration of an air conditioner according to a third embodiment of the present invention. Here, the same elements identical to those in the first embodiment of the air conditioner shown in FIG. 1 are indicated by the same reference numerals, and a detailed description of the same elements will be omitted and only a difference from the first embodiment of the air conditioner will be described.

Referring to FIG. 8, the bypass pipe 86 may connect the separating means 90 and the accumulator 8.

In a heating operation of the air conditioner, a refrigerant introduced into the bypass pipe 86 from the plurality of unit channels 20 and 30 may be introduced into the accumulator 8 and then separated into a liquid refrigerant component and a vapor refrigerant component. The vapor refrigerant component separated in the accumulator 8 may be introduced into the compressor 1 through the compressor inflow pipe 85, and the liquid refrigerant component separated in the accumulator 8 may remain intact in the accumulator 8.

Figure 9:
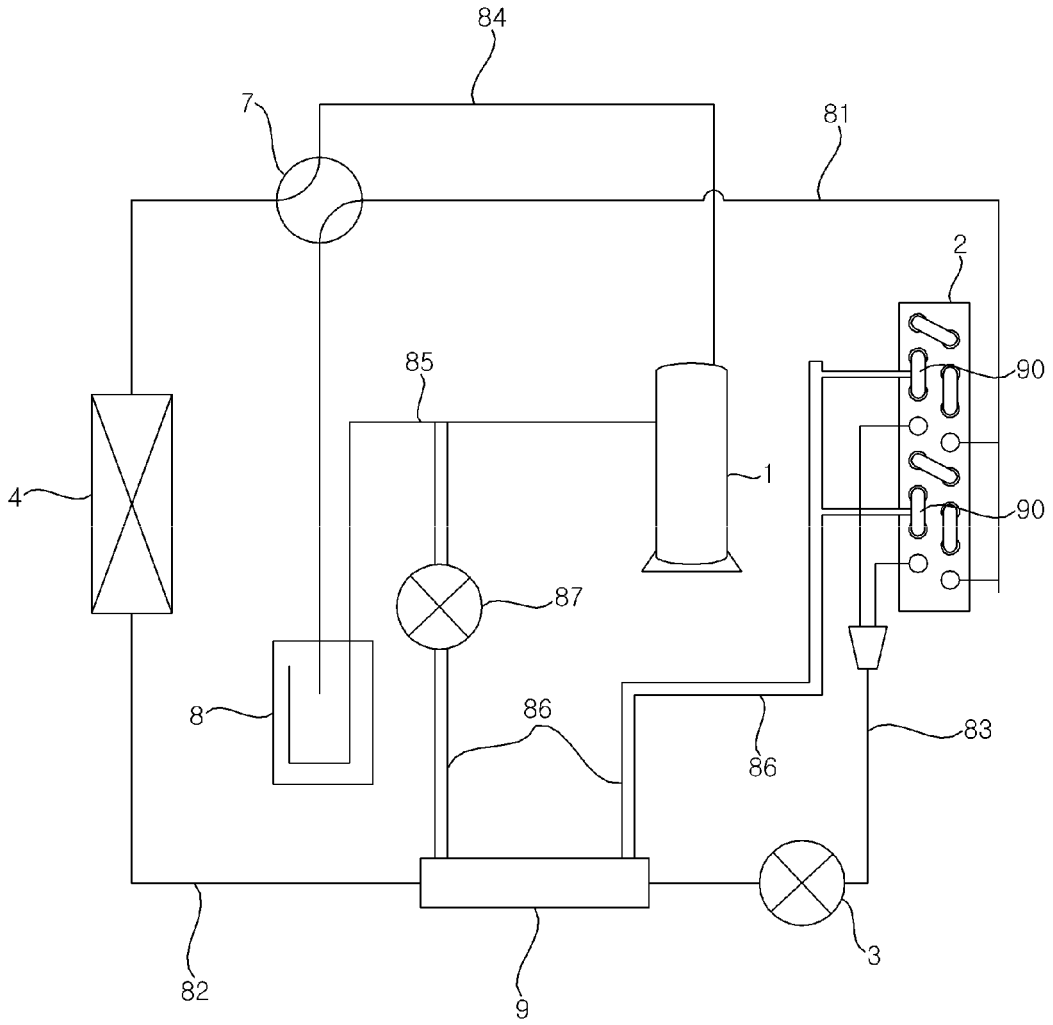
FIG. 9 is a diagram illustrating a configuration of an air conditioner according to a fourth embodiment of the present invention.

FIG. 9 is a diagram illustrating a configuration of an air conditioner according to a fourth embodiment of the present invention. Here, the same elements identical to those in the first embodiment of the air conditioner shown in FIG. 1 are indicated by the same reference numerals, and a detailed description of the same elements will be omitted and only a difference from the first embodiment of the air conditioner will be described.

Referring to FIG. 9, a supercooling device 9 is further installed in the second refrigerant pipe 82. The bypass pipe 86 may pass through the supercooling device 9.

In a heating operation of the air conditioner, a refrigerant having passed through the indoor heat exchanger 4 may be introduced into the supercooling device 9 through a front portion of the second refrigerant pipe 82. The refrigerant introduced into the supercooling device 9 may become supercooled by performing heat exchange with a refrigerant flowing in the bypass pipe 86 and be then introduced into the expansion device 3 through a rear portion of the second refrigerant pipe 82.

Figure 10:
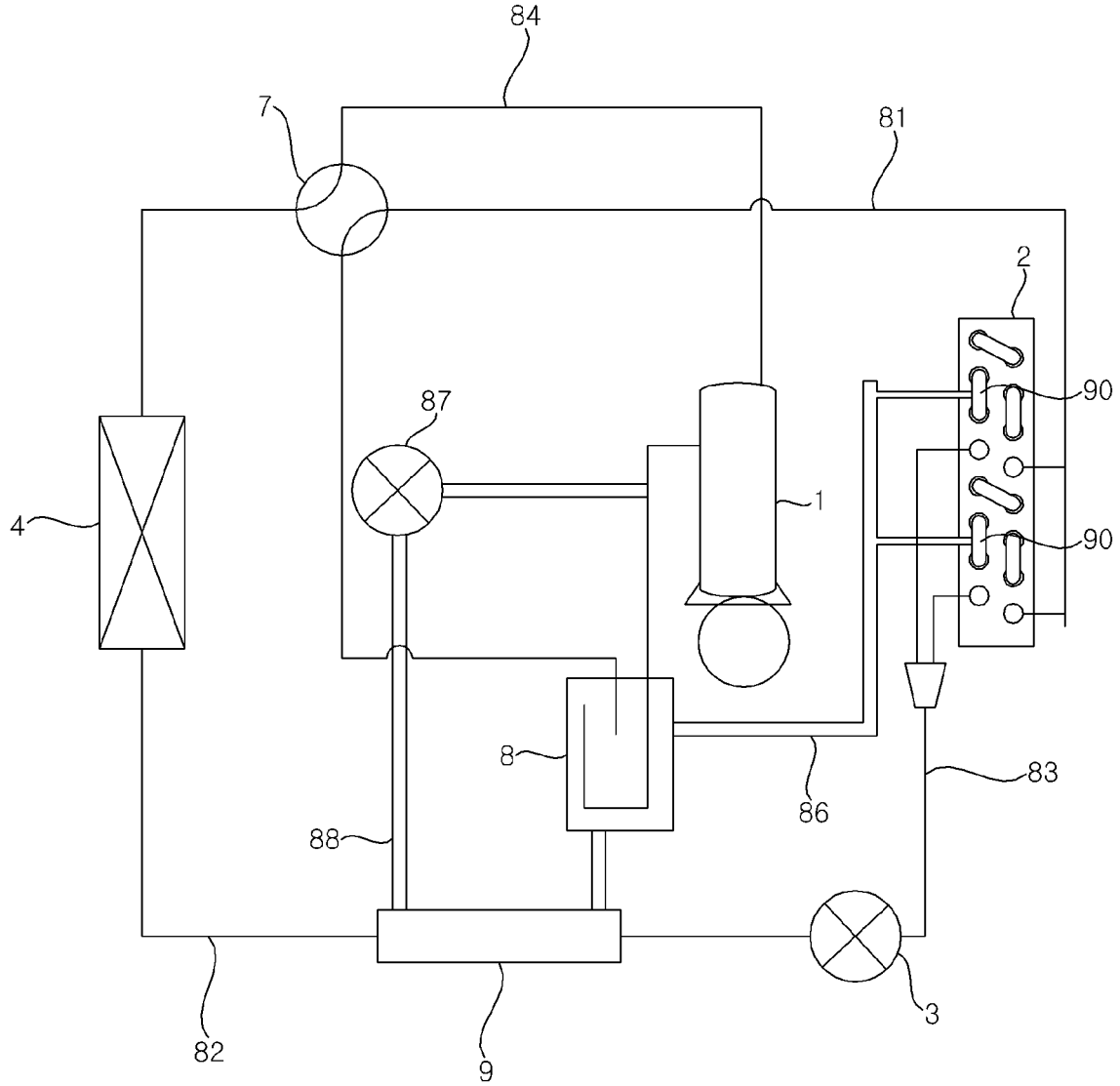
FIG. 10 is a diagram illustrating a configuration of an air conditioner according to a fifth embodiment of the present invention.

FIG. 10 is a diagram illustrating a configuration of an air conditioner according to a fifth embodiment of the present invention. Here, the same elements identical to those in the third embodiment of the air conditioner shown in FIG. 8 are indicated by the same reference numerals, and a detailed description of the same elements will be omitted and only a difference from the first embodiment of the air conditioner will be described.

Referring to FIG. 10, a supercooling device 9 is installed in the second refrigerant pipe 82. The air conditioner according to the fifth embodiment further includes an auxiliary bypass pipe 88 connecting the accumulator 8 and the compressor inflow pipe 85 and passing through the supercooling device 9.

The flow rate control valve 87 may be installed in the auxiliary bypass pipe 88 rather than the bypass pipe 86.

In a heating operation of the air conditioner, a refrigerant introduced into the bypass pipe 86 from the plurality of unit channels 20 and 30 may be introduced into the accumulator 8 and then separated into a liquid refrigerant component and a vapor refrigerant component. The vapor refrigerant component separated in the accumulator 8 may be introduced into the compressor 1 through the compressor inflow pipe 85.

In the heating operation, the auxiliary bypass pipe 88 may allow the liquid refrigerant component separated in the accumulator 8 to pass through the supercooling device 9 and thereby turned into a vapor refrigerant component and bypassed to the compressor inflow pipe 85.

As such, as the air conditioner according to embodiments of the present invention separates a refrigerant in each of the plurality of unit channels 20 and 30 of the outdoor heat exchanger 2 into a liquid refrigerant component and a vapor refrigerant component in a heating operation in a cold region and bypasses the separated refrigerant to the compressor suction channels 81, 8, 85, it is possible to reduce not just a refrigerant pressure loss in the outdoor heat exchanger 2 but also a refrigerant flow rate in the outdoor heat exchanger 2 to additionally reduce a pressure loss of a refrigerant flowing in a rear portion of the outdoor heat exchanger 2, thereby improving heating performance in the cold region.

As the air conditioner according to embodiments of the present invention separates a refrigerant in each of the plurality of unit channels of the outdoor heat exchanger into a liquid refrigerant component and a vapor refrigerant component in a heating operation in a cold region and bypasses the separated refrigerant to the compressor suction channels, it is possible to reduce not just a refrigerant pressure loss in the outdoor heat exchanger but also a refrigerant flow rate in the outdoor heat exchanger to additionally reduce a pressure loss of a refrigerant flowing in a rear portion of the outdoor heat exchanger, thereby improving heating performance in the cold region.

Effects of the present invention should not be limited to the aforementioned effects and other unmentioned effects will be clearly understood by those skilled in the art from the claims.

It may be understood by one of ordinary skill in the art that many other modifications and variations may be made to the present invention without departing from the essential features of the invention. Accordingly, the embodiments described thus far should be construed as being exemplary but not as limiting. The scope of the invention is defined by the claims rather than the detailed description above, and it should be also interpreted that all the modifications and variations induced from the meaning and scope of the claims and the equivalents thereof are also within the scope of the invention.

What is claimed is:

1. An air conditioner comprising a compressor, an outdoor heat exchanger, an expansion device, and an indoor heat exchanger, wherein the outdoor heat exchanger comprises:

a refrigerant channel that is partitioned into a first unit channel and a second unit channel; and a plurality of separating devices, wherein each of the plurality of separating devices is located in each of the first unit channel and the second unit channel and configured to, in a heating operation, separate refrigerant into a liquid refrigerant component and a vapor refrigerant component, and wherein the air conditioner further comprises:

a compressor suction channel that is connected to a heating-operation outlet of the outdoor heat exchanger and an inlet of the compressor;

a bypass pipe that is connected to the plurality of separating devices and the compressor suction channel and that is configured to, in the heating operation, bypass the vapor refrigerant component to the compressor suction channel;

a first parallel connection channel that is connected to a first side of each of the first unit channel and the second unit channel in parallel and that is configured to, in the heating operation, introduce the refrigerant into the first unit channel and the second unit channel of the outdoor heat exchanger;

a second parallel connection channel that is connected to a second side of each of the first unit channel and the second unit channel in parallel and that is configured to, in the heating operation, discharge the refrigerant that has passed through the first unit channel and the second unit channel to an outside of the outdoor heat exchanger;

a serial connection channel that is connected to the first unit channel and the second unit channel in serial and that is configured to, in a cooling operation, bypass the refrigerant that has passed through the first unit channel from the second parallel connection channel and redirect the refrigerant to the second unit channel;

a serial connection valve that is located on the serial connection channel and that is configured to open the serial connection channel in the cooling operation and close the serial connection channel in the heating operation;

a first distributor that is connected to the first parallel connection channel and that is configured to, in the heating operation, distribute a portion of refrigerant from the first parallel connection channel to the first unit channel; and a second distributor that is connected to the first parallel connection channel and that is configured to, in the heating operation, distribute a remainder of refrigerant from the first parallel connection channel to the second unit channel;

wherein the plurality of separating devices comprise:

a first return pipe that is positioned in a middle of a plurality of first return pipes that connect adjacent refrigerant pipes among a plurality of refrigerant pipes in the first unit channel; and a second return pipe that is positioned in a middle of a plurality of second return pipes that connect adjacent refrigerant pipes among a plurality of refrigerant pipes in the second unit channel.

2. The air conditioner of claim 1, wherein:

the first return pipe and the second return pipe comprise a pair of straight parts arranged in parallel, and an arc-shape bending part connected to one end of each of the straight parts, and the bypass pipe is connected to the arc-shape bending part and arranged in a longitudinal direction of the straight parts.

3. The air conditioner of claim 2, wherein the first return pipe and the second return pipe further comprise an expansion part that has an inner space larger than a remaining space of the return pipe.

4. The air conditioner of claim 1, wherein:

the first return pipe and the second return pipe comprise a pair of straight parts arranged in parallel, and a spring-shape bending part connected to one end of each of the straight parts, and the bypass pipe is connected to the spring-shape bending part and arranged in a longitudinal direction of the straight parts.

5. The air conditioner of claim 1, wherein:

the compressor suction channel comprises an accumulator configured to separate the liquid refrigerant component and the vapor refrigerant component, and a compressor inflow pipe connected to an outlet of the accumulator and the inlet of the compressor, and the bypass pipe is connected to the plurality of separating devices and the compressor inflow pipe.

6. The air conditioner of claim 1, further comprising a flow rate control valve located on the bypass pipe and configured to open the bypass pipe in a heating operation and close the bypass pipe in a cooling operation.

7. The air conditioner of claim 1, further comprising a backflow preventing valve that is located on the first parallel connection channel and that is configured to, in the cooling operation, block the refrigerant that has passed through the first unit channel from backflowing to the second unit channel.

8. The air conditioner of claim 1, further comprising a parallel connection valve that is located on the second parallel connection channel and that is configured to close the second parallel connection channel in the cooling operation and open the second parallel connection channel in the heating operation.

9. The air conditioner of claim 1, wherein:

the compressor suction channel comprises an accumulator configured to separate the liquid refrigerant component and the vapor refrigerant component, and a first refrigerant pipe configured to connect the heating-operation outlet of the outdoor heat exchanger and an inlet of the accumulator, and the bypass pipe is connected to the plurality of separating devices and the first refrigerant pipe.

10. The air conditioner of claim 1, wherein:

the compressor suction channel comprises an accumulator configured to separate the liquid refrigerant component and the vapor refrigerant component, and the bypass pipe is connected to the plurality of separating devices and the accumulator.

11. The air conditioner of claim 1, further comprising a supercooling device that is located on a second refrigerant pipe that is connected to a heating-operation outlet of the indoor heat exchanger and a heating-operation inlet of the expansion device, wherein the bypass pipe passes through the supercooling device.

12. The air conditioner of claim 1, further comprising a third refrigerant pipe that is connected to an outlet of the expansion device and the first parallel connection channel of the outdoor heat exchanger.

13. The air conditioner of claim 1, further comprising a plurality of headers, wherein each of the plurality of headers is connected to the second parallel connection channel.

14. The air conditioner of claim 1, wherein the first distributor and the second distributor are configured to, in the cooling operation, distribute refrigerant from the first unit channel and the second unit channel to the first parallel connection channel.

* * * * *